US007258754B2

(12) United States Patent
Bégin et al.

(10) Patent No.: US 7,258,754 B2
(45) Date of Patent: Aug. 21, 2007

(54) METHOD OF FABRICATING A BARE ALUMINUM CONDUCTOR

(75) Inventors: Rosaire Bégin, Trois Rivières (CA); Danny S. Elder, Montoursville, PA (US); Graham Henry Stratford, Napanee (CA)

(73) Assignee: Alcan International Limited, Montreal, Quebec (CA)

( * ) Notice: Subject to any disclaimer, the term of this patent is extended or adjusted under 35 U.S.C. 154(b) by 680 days.

(21) Appl. No.: 10/421,614

(22) Filed: Apr. 23, 2003

(65) Prior Publication Data

US 2004/0211588 A1 Oct. 28, 2004

(51) Int. Cl.
*B21C 47/26* (2006.01)
*C22F 1/04* (2006.01)

(52) U.S. Cl. ..... 148/518; 148/520; 148/535

(58) Field of Classification Search ..... 148/518, 148/520, 535

See application file for complete search history.

(56) References Cited

U.S. PATENT DOCUMENTS 3,745,034 A * 7/1973 Smith et al. ..... 427/460
3,794,749 A * 2/1974 Wharton ..... 174/28
3,975,581 A 8/1976 Lowenhar ..... 333/33
4,000,362 A 12/1976 Kawaguchi et al. ..... 174/120
4,096,459 A 6/1978 Lowenhar ..... 333/96
4,265,690 A 5/1981 Lowenhar ..... 156/161
4,439,255 A 3/1984 Imai et al. ..... 156/49
4,904,557 A * 2/1990 Kubo ..... 430/56
6,859,994 B2 * 3/2005 Oshima et al. ..... 29/602.1

FOREIGN PATENT DOCUMENTS

JP 58022334 2/1983

* cited by examiner

*Primary Examiner*—George Wyszomierski
(74) *Attorney, Agent, or Firm*—Cooper & Dunham LLP

(57) ABSTRACT

A method of fabricating a bare aluminum electrical conductor including a step of heat treating the conductor while wound on a winding form. The method comprises the step of coating the outer surface of the aluminum conductor with an inorganic powder material prior to winding the wire or cable on the winding form. The invention also relates to a method of protecting an aluminum conductor from damage during heat treatment and shipment when wound on a winding form. This method comprises providing a layer of aluminum or aluminum alloy between said conductor and parts of said winding form that would contact said wound conductor if not for said layer.

25 Claims, 4 Drawing Sheets

METHOD OF FABRICATING A BARE ALUMINUM CONDUCTOR

FIELD OF THE INVENTION

The present invention relates to a method of fabricating a bare aluminum electrical conductor, e.g. a wire or cable, and particularly to such a method by which so-called heat treating damage of the aluminum conductor can be prevented or minimized when the conductor is heat-treated while coiled or wound on a winding form, such as a basket, reel, spool or bobbin.

BACKGROUND OF THE INVENTION

Aluminum is a metal which offers a good compromise between electrical conductivity, mechanical strength, weight and cost. As such, the use of aluminum wire or cable as an electrical conductor has increased significantly in recent years. However, there are many possible applications where aluminum wire or cable may be used only if certain physical and mechanical properties are achieved. These include, for example, utility cable, building wire, telephone cables, battery cables, automotive harness wiring, aircraft cables, transformer wire, magnet wires and appliance cords.

Aluminum conductors, in commercial practice, are commonly produced by drawing down an aluminum or aluminum alloy rod in a so-called drawbench having a succession of dies through which the rod is drawn under tension to achieve a progressive reduction in diameter. At the exit end of the drawbench, the wire is wound onto a winding form, e.g. a basket, reel, spool or bobbin. The wire wound on the winding form is either shipped directly to customers, or proceeds to other equipment for further processing, for example, a wire stranding plant for manufacturing a conductor cable. The aluminum cable is also mostly wound or coiled on a winding form before being shipped to customers.

It is, in many cases, required that the aluminum conductor coiled on a spool be heat-treated (e.g. annealed) in order to provide certain mechanical and physical properties for further processing or to achieve desirable properties in the final product. When the aluminum conductor is heat-treated while coiled or wound on the form, especially when heat treated in a high temperature furnace and/or for a long period of time, the individual wire strands in close contact with each other are likely to stick together or to the centre or sides of the form. This may be due, for example, to intermetallic diffusion occurring in the contact zone or one wire pulling over the dry surface of another wire. This leaves markings on the surface of the conductor, or causes the wire to "hang-up" (stick or catch to itself) during unwinding, resulting in "catching" or wire breakage. These markings and/or the effects caused by the "catching" incidents are referred to as "heat treating damage." This heat treating damage reduces the commercial value of the conductor and possibly its performance. This damage is particularly significant when the heat treatment is the last step on the process before supplying the wire or cable to the customers.

Conventionally, to solve the above problems, i.e, to prevent heat treating damage, oils, silicones, stearates, and waxes, etc., have been used to provide some degree of lubricity to the coiled strands throughout the heat treatment process. At times, oils are sprayed onto or flushed through the coiled wire or cable to minimize the damage. These prior art techniques reduce, but do not eliminate, the metal to metal damage when wire products are wound and unwound from a winding form, particularly at temperatures above about 260° C. The materials used for lubrication must be carefully selected to minimize staining or corrosion of the aluminum itself. Further, these prior art materials, such as oil, silicone, stearate and wax, create an environmental, fire or explosion hazard.

There is, therefore, a need to overcome the difficulties of the prior art procedures and to prevent or minimize heat treating damage of bare aluminum conductors, such as wire or cable.

SUMMARY OF THE INVENTION

According to one aspect of the invention, there is provided a method of preventing heat treating damage to an aluminum conductor having a bare outer surface when said conductor is heat-treated while wound on a winding form, the method comprising the step of coating the outer surface of the aluminum conductor with an inorganic powder material prior to winding the wire or cable on the winding form, and then subjecting said conductor wound on the winding form to a heat treatment.

According to another aspect of the invention, there is provided a process for preventing heat treating damage to an aluminum conductor when heat-treated while wound on a winding form, the process comprising a step of applying inorganic powder on the surface of the aluminum conductor, prior to winding the conductor on a winding form and heat-treating the wound conductor, wherein the inorganic powder applied on the surface serves as a physical and/or chemical barrier between individual strands of the wound conductor through the duration of the heat-treatment, thereby to prevent or minimize surface damage of the conductor due to close contact between the strands of wound conductor and between the wound conductor and the winding form.

According to yet another aspect of the invention there is provided a method of protecting an aluminum conductor from damage during heat treatment and shipment when wound on a winding form, which comprises providing a layer of aluminum or aluminum alloy between the conductor and parts of the winding form that would contact the wound conductor if not for the layer. Preferably, the aluminum conductor has an outer surface coated with an inorganic powder.

According to yet another aspect of the present invention, there is provided a method of fabricating a bare electrical conductor, which comprises forming an elongated conductor from a mass of aluminum or aluminum alloy, coating a bare outer surface of the conductor with an inorganic powder material, winding the conductor on a winding form, and heat treating the conductor while wound on the form.

By the term "bare outer surface" we mean a surface that does not have a layer or covering of electrically insulating material, leaving the metal of the conductor exposed. The surface may, of course, have a thin coating of oil or other fluid surface treatment. Consequently, a "bare electrical conductor" is a conductor having a bare outer surface, although the term should not necessarily imply that the bare electrical conductor is excluded from subsequent coating with an insulating coating material (e.g. plastics or rubber) to form an insulated electrical conductor. Thus, the present invention extends to a method of fabricating an insulated electrical conductor by coating a bare electrical conductor produced by the above method with at least one layer of electrically insulating material.

By the term "heat treatment" we mean any procedure of elevating the temperature of the conductor for any period of time. Preferably, however, the heat treatment is such that it elevates the temperature to such an extent and such a time that heat treatment damage is likely to be caused without resort to the present invention. Normally, the heat treatment is an annealing treatment of the kind frequently carried out on electrical conductors made of aluminum or aluminum alloy.

By the term "inorganic powder", we mean to exclude carbon-containing powders (in which the carbon is either elemental or reacted) and we mean to include mineral and ceramic powders, such as, for example metal oxides (e.g. aluminum oxide or aluminum trihydrate), talc (e.g. Luzenac Vertal 7 or 92 Talc), boron nitride, ceramics, etc. The powder should be capable of withstanding the temperatures employed for the heat treatment without melting, decomposition or reaction with the aluminum (e.g. it should be non-corrosive). The powder should also preferably be non-staining, non-volatile and non-flammable. Most preferably, the powder should also have a compatible colour with the aluminum surface (e.g. white or gray) such that the coating is not itself immediately noticeable, and have no risk of causing health problems for workers in the vicinity of the location where the powder is used. Powders of graphite should preferably be avoided because they are apt to stain and cellulose powders should also be avoided because of a tendency to burn or even explode. It is to be noted that graphite and cellulose are not regarded as inorganic materials in the context of this invention.

The coating of the inorganic powder may be carried out by passing the conductor through a fluidized mass of the inorganic powder, which may also be electrostatically charged or partially charged (i.e. charged at a voltage less than the maximum that can be applied by a particular apparatus).

Preferably, parts of the winding form that would otherwise contact the electrical conductor are covered with an aluminum sheet to isolate the wound conductor from direct contact with the winding form.

The metal used to form the conductors of the present invention include high purity aluminum and aluminum alloys conventionally used for electrical conductors.

A further understanding of other aspects, features and advantages of the present invention will be realized by reference to the following description, appended claims and accompanying drawings.

DETAILED DESCRIPTION OF THE PREFERRED EMBODIMENT(S)

Figure 1:
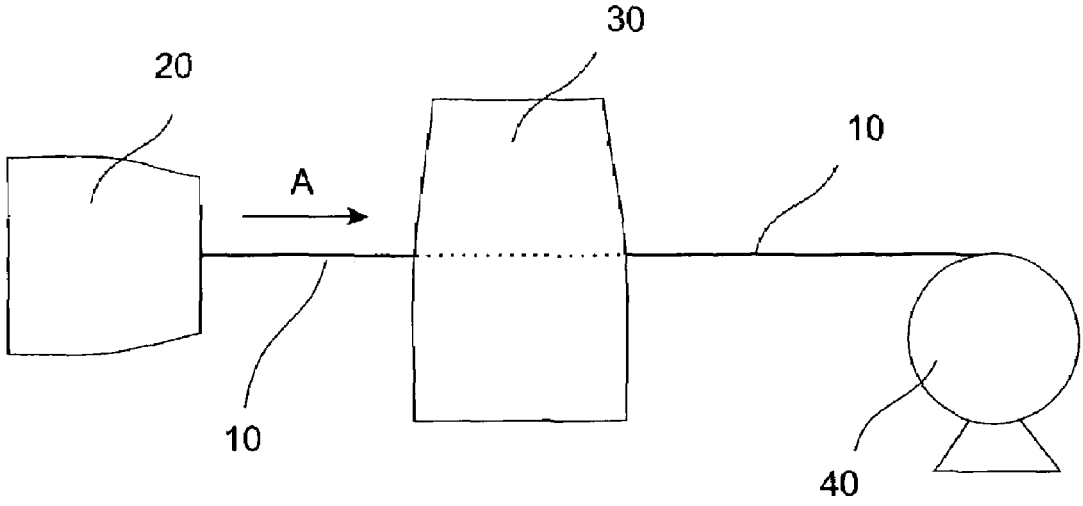
FIG. 1 is a schematic view of illustrating a method according to one preferred embodiment of the present invention.

FIG. 1 is a schematic view showing apparatus used for a method according to one embodiment of the present invention. In FIG. 1, reference numeral 20 denotes a drawing die (drawbench) or a stranding machine. A bare aluminum (or aluminum alloy) conductor 10, such as a wire or cable, exits the drawing die or stranding machine and advances towards a winding form 40, e.g. a basket, reel, spool or bobbin, in the direction A, where it is wound or coiled on the form. (For the convenience of description, the term "aluminum" will be used to refer both to aluminum itself and aluminum alloys.) Before the conductor 10 is wound on the winding form 40, it passes through a powder applicator 30 which applies a coating of powder to the outer surface of the conductor 10 before the conductor is wound on the form 40.

The powder applicator 30 may be a commercially available device, for example, a "Flexicoat System Cable Duster®" from Electrostatic Technology Inc, of Branford, Conn., in the United States. Powder applicators of this kind are conventionally used for applying a powder coating to a wire-like article so that the coating can subsequently be fused to form a protective or decorative layer. Essentially, any apparatus that exposes the conductor to a mass of inorganic powder and provides some means for covering the bare metal surface of the conductor to particles of the powder may be employed.

As noted, in the present invention, inorganic powder is applied on the bare uninsulated outer surface of the conductor 10 as it passes through the powder applicator 30 before it is coiled on the form 40, which is subsequently heat-treated in the coiled state. The heat treatment may be carried out, for example, in a batch style, continuous or semi-continuous operation at a suitable temperature and for a suitable length of time. Normally the heat treatment is a batch anneal carried out at a temperature in the range of 250 to 500° C. for a period of 4 to 30 hours in an electric or gas oven/furnace utilizing indirect blown hot air, without direct impingement.

In preferred forms of the invention, the inorganic powder material is talc or boron nitride. The size of the powder particles is typically around 9 microns in average diameter, but may be larger or smaller if desired. A typical range might be 1 to 20 microns in average diameter.

The inorganic powder can be applied onto the surface of the wire or cable as it passes through the powder applicator 30, where the powder mass is maintained in a fluidized state, in a electrostatically charged state, or in a partially electrostatically charged state. The electrostatic charge is achieved by applying a high voltage to the powder mass. The applicator may consist of a simple closed chamber having a hole in one side wall for entry of the conductor and an aligned hole in an opposite wall for exit of the coated conductor. Within the chamber, the solid powder may be fluidized or electrostatically charged, as indicated, so that the powder will stick to the outer surface of the conductor as it passes through the chamber. Often a conductor bears a trace layer of lubricant resulting from the drawing process. If so, this trace layer will help the powder to stick to the conductor surface. However, the amount of lubricant should not be so large that a fire hazard is created as a result. Apart from such trace amounts, the powder coating of the present invention is free of solvents, oils, adhesives, and other organic materials. Unlike conventional coatings, the powder coating of the present invention is free of petroleum distillates, paint powders, and coatings that fuse to form a protective finish.

The coating is simply a layer of inorganic particles held to the surface by electrostatic attraction and/or a trace quantity of lubricant such as drawing oil.

The quantity of the inorganic powder used for the coating process of the invention is not particularly limited. There should of course be sufficient powder to prevent adjacent coils from sticking together, but this minimum amount can easily be applied by the coating apparatus employed in the present invention. Any amount more than the minimum required to act as a release layer is probably wasted and unnecessary. Indeed a heavy coating merely causes powder to fall off the conductor and creates a cleaning issue.

As will be understood by persons skilled in the art, the coiled wire or cable coated with inorganic powder is then subjected to a heat-treatment in order to provide certain mechanical and physical properties required for subsequent processing, for example, further drawing or cable-stranding.

In accordance with another preferred aspect of the invention, the surfaces of the winding form that contact the aluminum conductor when it is wound thereon are covered with a layer of aluminum or aluminum alloy to prevent damage to the aluminum conductor during heat treating and shipment or transport. Such damage may otherwise be caused by contact between the aluminum conductor and the material of the winding form. Such forms are normally made of steel and the aluminum lining protects the aluminum conductor from abrasion from sharp or rough areas of the steel and from contamination from rust, dirt, etc. The aluminum liner is sufficiently inexpensive that it may be shipped with the conductor wound on the form without introducing a significant additional cost into the economics of production.

Figure 4:
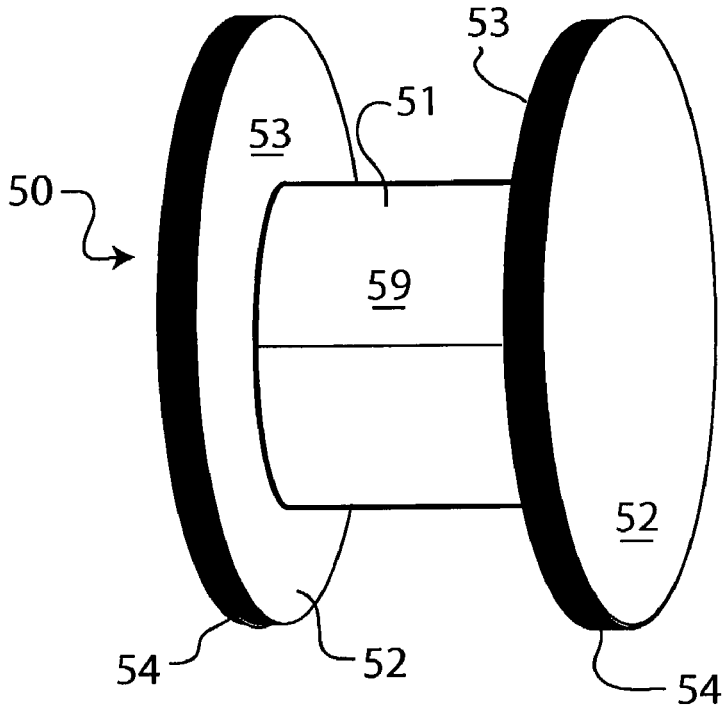
FIG. 4 is a perspective view of a winding form of the kind used in connection with the present invention.
Figure 5:
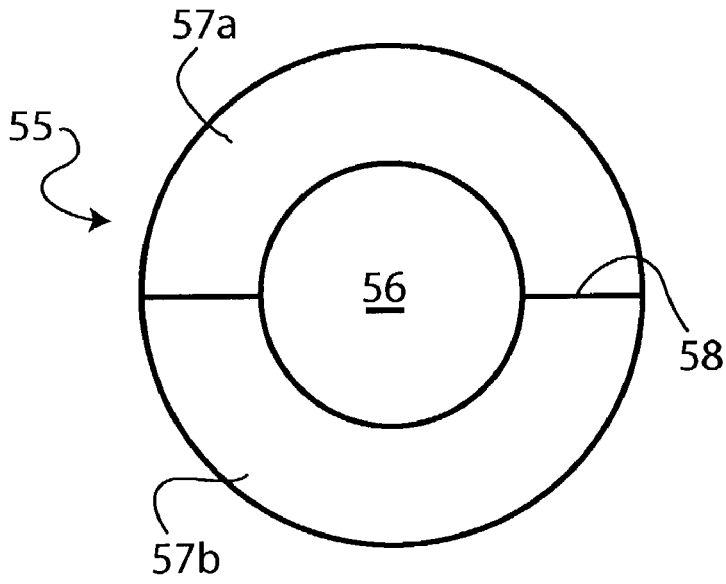
FIG. 5 is a top plan view of a cut-out made of aluminum sheet material for providing side wall protection of a winding form of the kind shown in FIG. 4.

FIG. 4 shows a typical winding form 50 of the kind with which the present invention may be employed. This form 50 is shaped as a reel having a central drum 51 acting as a core around which the conductor (not shown) is wound, and circular side pieces 52 extending beyond the surface of the drum 50. FIG. 5 shows a cut-out 55 for protecting an inner surface 53 of each side piece 52. The cut-out 55 is circular with a central hole 56 dimensioned to fit around the drum 51 while extending to an outer edge 54 of the side piece 52. The cut-out is in two parts 57*a* and 57*b* divided by a straight diametrical separation 58 so that the cut-out may be fitted around the drum on the inside of a side piece. The surface 60 of the drum itself is protected by a rectangular strip 59 of aluminum sheet wound around the drum prior to coiling of the conductor thereon. The aluminum sheet used to protect the side pieces and the drum may be, for example, a sheet of approximately 0.0037 inches to 0.100 inches in thickness (for example, 5052 H-19 Aluminum sheet). While it would be possible to use sheets having thicknesses outside the stated range, a thinner sheet would lack the stiffness required to facilitate installation and a thicker sheet would be unduly costly and difficult to fabricate.

It is not necessary to coat the liner sheet with an inorganic powder. The conductor, if coated in this way, already has the ability to prevent sticking and heat treating damage with the adjacent liner sheet.

Figure 6:
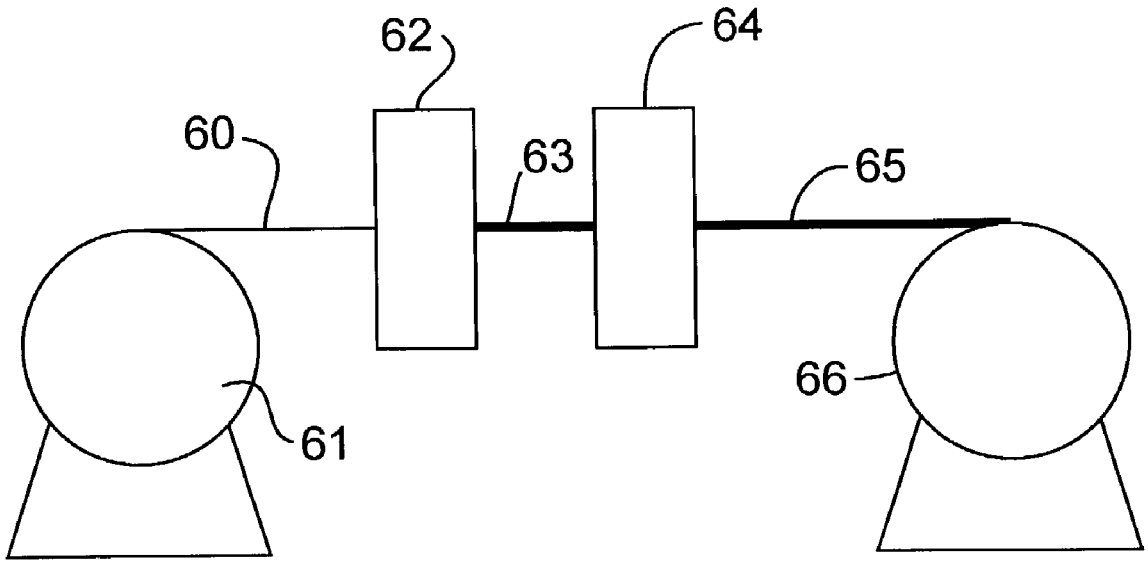
FIG. 6 is a schematic view of the coating of a bare electrical conductor produced according to the present invention to form an insulated electrical conductor.

As noted above, the bare electrical conductor produced according to the present invention may be coated with a solid insulating material (e.g. plastics or rubber) to form an insulated electrical conductor. The insulated layer itself may be coated with an inorganic powder material of the type mentioned above before being wound onto a winding form for distribution to customers. The inorganic powder helps to prevent sticking of the insulating material to itself (one coil to another) when present on the winding form. This is illustrated in a simplified schematic form in FIG. 6. Here, bare electrical conductor 60 produced according to the present invention is unwound from a storage bobbin 61 and passed first through a coating machine 62 for producing an outer layer of insulating material, thus forming an insulated electrical conductor 63, and then through a powder coating machine 64 similar machine 30 of FIG. 1. The powder coating machine may be fluidized and/or have the capacity to apply an electrostatic charge to facilitate sticking of the powder to the insulated conductor. The powder-coated insulated conductor 65 is then wound on a take-up bobbin 66 for storage or shipment. The preferred inorganic coating material for this step is talc.

The present invention and its advantages will be further understood from the following examples, which are not intended to limit the scope of the present invention.

EXAMPLES

An older laboratory model electrostatic powder applicator was obtained from ETI Corp. and used to apply both boron nitride and Vertal talc onto bare aluminum wire during a drawing process.

The drawing speed was 2200 meters/min., using fresh drawing oil. The traverse was set at 1.5×wire size. The powder applicator was installed just after the draw machine capstan and prior to the spooler takeup.

The talc and BN powder were applied at 3 levels using no electrostatic charge or varying percentages of the full magnitude of the voltage that could be applied, as follows:

First 5 bobbins with air fluidizing only–no electrostatic charge

Second 5 bobbins with 20% electrostatic=approx. 20 KV

Remaining 16 bobbins with 100% electrostatic dial=approx. 63 KV

Note: Late during the evaluations, it was realized that the powder required stirring. For this reason, some bobbins did not receive their full share of powder. The estimated usage of talc was <5 lbs. and BN <3 lbs. for all runs. Most of this usage was thought to be from spillage and the temporary equipment/installation being used.

Powder Equipment Settings:

| | Talc | BN |
|---|---|---|
| Bed Air | 200 | ½ Turn past 200 (Max available) |
| Inlet Air Vortex | 50 | 50 |
| Outlet Air Vortex | 100 | 200 |
| Vibrator Air | 75 | 150 |

Note: The settings were higher for BN since it was more difficult to fluidize and contain. The talc and BN both required frequent physical stirring to maintain a cloud of dust, although this was not expected to be needed in equipment relying on powder fluidization.

Testing of Wire Surface for Dust

The wire surface appeared slightly duller with the powder turned on at low levels. The bobbins run at 100% electrostatic had obvious, although light levels of powder.

Annealing

The drawn wire was all annealed at 315° C. for 8 hours.

Winding Off at Scrap Line

During the winding off, it was quickly apparent that the wire paid off well and that there were only minor "catching" incidents. In comparison to previous bobbins, with no powder, the powder coated bobbins were a tremendous improvement in ease of payoff. Even severely trapped wires showed only minor damage. Uncoated, annealed bobbins have previously always severely caught and had numerous broken wire incidents during payoff at the scrapper.

Six bobbins of BN coated wire were wound off–2 each at 0% Electrostatic, 20% Electrostatic, and 100% Electrostatic. After approximately 300 meters of wire was pulled off, the wire surface drastically improved. The marking on the bobbins using BN powder disappeared except for one bobbin. The one bobbin which retained the marking was at 0% Electrostatic.

Figure 2A:
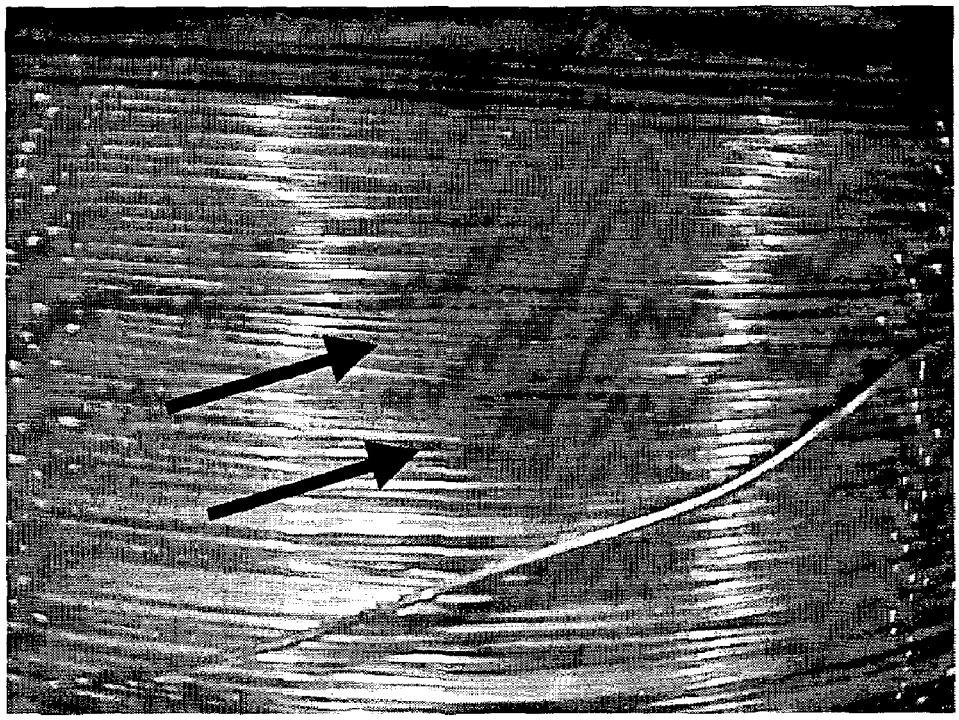
FIGS. 2*a* and 2*b* are photographs showing markings on the surface of aluminum wire and cable after being heat-treated in a coiled condition according to the Example below.
Figure 2B:
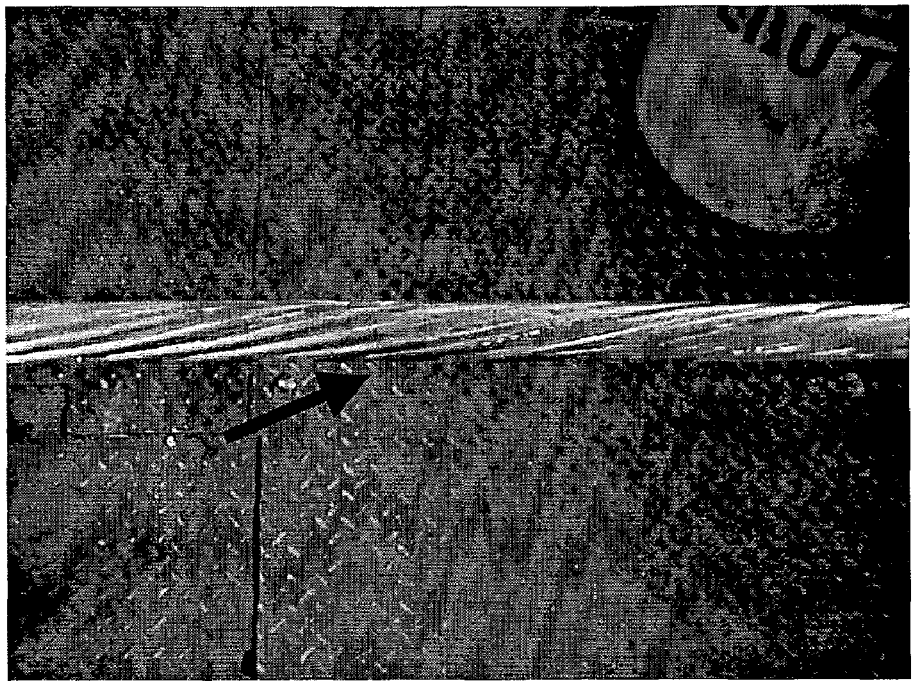
Figure 3:
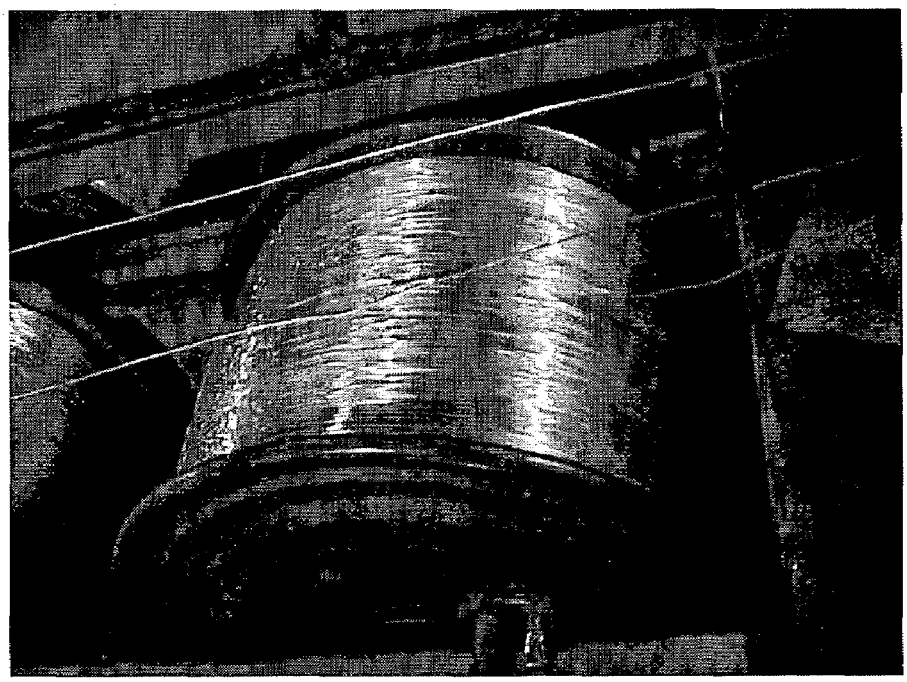
FIG. 3 is a photograph showing "catching" incidents occurring when the aluminum wire and cable is paid off from a spool after being heat-treated, according to the Example below.

It is believed that the bobbin that showed the marking did not receive its full share of powder and also indicates that without powder the damage will exist. This means that there is no reduction in bobbin marking from the fresh drawing oil. The type of damage that can be produced is shown in FIGS. 2*a*, 2*b* and 3 of the accompanying drawings.

Six bobbins of talc coated wire were then wound off. The bobbins with 100% electrostatic were identical to the BN coated bobbins—no marking after approx. 300 meters. The 0% and 20% Electrostatic bobbins did show minimal, but still present marking.

Staining

There were no serious indications of straining. No difference was detected between the various levels of powder application.

Conclusions

BN powder applied either by a fluidized bed only or with electrostatic assistance dramatically improves the surface quality of annealed wire on bobbins.

Talc applied with electrostatic assistance provides similar surface quality to BN powder, while being much less expensive.

Neither BN nor talc detracts from the appearance of the finished conductor.

The usage rates of powder are very low, which makes the powder application economical.

Both BN and talc powders are easily and safely handled by commercially available electrostatic dusting equipment and do not create significant house keeping issues for a production operation.

While the present invention has been described with reference to several specific embodiments, the description is illustrative of the invention and is not to be construed as limiting the invention. Various modifications and variations may occur to those skilled in the art with out departing from the true spirits and scope of the invention as defined by the appended claims.

What we claim is:

1. A method of preventing heat treatment damage to an aluminum conductor having a bare outer surface when said conductor is heat-treated while wound on a winding form, the method comprising the step of coating the outer surface of the aluminum conductor with an inorganic powder material prior to winding the conductor on the winding form, said coating step forming a layer of said inorganic powder material held to said outer surface only by electrostatic attraction and/or a trace quantity of lubricant, winding the conductor onto a winding form, and then subjecting said conductor wound on the winding form to a heat treatment, whereby said layer of said inorganic powder prevents or minimizes surface marking, sticking, catching, and breakage of said conductor during unwinding of said conductor from said winding form.

2. A method of preventing heat treating damage to an aluminum conductor having a bare outer surface when said conductor is heat-treated while wound on a winding form, the method comprising the step of coating the outer surface of the aluminum conductor with an inorganic powder material prior to winding the conductor on the winding form, and then subjecting said conductor wound on the winding form to a heat treatment, wherein the inorganic powder material is selected from the group consisting of metallic oxides, ceramic materials and minerals.

3. The method of claim 2, wherein the inorganic powder material is selected from the group consisting of talc and boron nitride.

4. The method of claim 1, wherein the inorganic powder material is coated onto the surface of the conductor by charging the powder electrostatically and exposing the conductor to the charged powder.

5. The method of claim 4, wherein the conductor is exposed to the charged powder by passing the conductor through a mass of the charged powder.

6. The method of claim 1, wherein the step of coating the inorganic powder comprises passing the conductor through a fluidized mass of the inorganic powder.

7. The method of claim 1, wherein the heat treatment is carried out at a temperature in the range of 250 to 500° C. for a period of 4 to 30 hours.

8. A method of preventing heat treating damage to an aluminum conductor having a bare outer surface when said conductor is heat-treated while wound on a winding form, the method comprising the step of coating the outer surface of the aluminum conductor with an inorganic powder material prior to winding the conductor on the winding form, and then subjecting said conductor wound on the winding form to a heat treatment, wherein, prior to heat treating the aluminum conductor wound on the winding form in a heat-treating environment, parts of the winding form that would otherwise contact said electrical conductor are covered with an aluminum sheet to isolate the wound conductor from direct contact with the winding form.

9. A process of preventing heat treating damage to an aluminum conductor when heat-treated while wound on a winding form, the process comprising a step of applying inorganic powder onto a bare surface of the aluminum conductor to form a coating thereon of said inorganic powder held to said surface only by electrostatic attraction and/or a trace quantity of lubricant, prior to winding the conductor on a winding form and heat-treating the wound conductor, wherein the inorganic powder applied onto said surface serves as a physical and/or chemical barrier between individual strands of the wound conductor through the duration of the heat-treatment, thereby to prevent or minimize surface marking, sticking, catching, and breakage of the conductor due to close contact between the strands of wound conductor and between the wound conductor and the winding form.

10. The process of claim 9, wherein the step of applying an inorganic powder includes a step of passing the conductor through a fluidized inorganic powder mass.

11. The process of claim 9, wherein the inorganic powder is electrostatically applied to the surface of the conductor.

12. The process of claim 11, wherein the step of applying an inorganic powder includes a step of passing the conductor through an electrostatically charged inorganic powder mass.

13. The process of claim 12, wherein the inorganic powder mass is partially electrostatically charged.

14. The process of claim 11, wherein the step of applying an inorganic powder includes a step of passing the conductor through an electrostatically charged and fluidized inorganic powder mass.

15. A process of preventing heat treating damage to an aluminum conductor when heat-treated while wound on a winding form, the process comprising a step of applying inorganic powder onto a bare surface of the aluminum conductor, prior to winding the conductor on a winding form and heat-treating the wound conductor, wherein the inorganic powder applied onto said surface serves as a physical and/or chemical barrier between individual strands of the wound conductor through the duration of the heat-treatment, thereby to prevent or minimize surface damage of the conductor due to close contact between the strands of wound conductor and between the wound conductor and the winding form, wherein the inorganic powder is selected from the group consisting of metallic oxide powder, ceramic powder and mineral powder.

16. The process of claim 15, wherein the inorganic powder is selected from the group consisting of talc powder and boron nitride powder.

17. A process of preventing heat treating damage to an aluminum conductor when heat-treated while wound on a winding form, the process comprising a step of applying inorganic powder onto a bare surface of the aluminum conductor, prior to winding the conductor on a winding form and heat-treating the wound conductor, wherein the inorganic powder applied onto said surface serves as a physical and/or chemical barrier between individual strands of the wound conductor through the duration of the heat-treatment, thereby to prevent or minimize surface damage of the conductor due to close contact between the strands of wound conductor and between the wound conductor and the winding form, and further comprising, prior to heat treating the conductor wound on the form, a step of covering the wound conductor on the form with an aluminum sheet to isolate the wound conductor from a heat-treating environment employed for said heat treatment, thereby to further prevent or minimize surface damage of the wire or cable.

18. Use of inorganic powder for preventing or minimizing surface marking, sticking, catching, and breakage of a bare aluminum conductor when heat-treated while wound into a coil, wherein the inorganic powder is coated on the surface of the conductor prior to winding the conductor into said coil to form a layer of the inorganic powder held to the surface only by electrostatic attraction and/or a trace quantity of lubricant, followed by winding the conductor into a coil and subjecting the coil to a heat treatment.

19. Use of inorganic powder for preventing or minimizing heat treating damage of a bare aluminum conductor when heat-treated while wound into a coil, wherein the inorganic powder is coated on the surface of conductor prior to winding the conductor into said coil, followed by subjecting the coil to a heat treatment, wherein the inorganic powder comprises talc or boron nitride.

20. The use of inorganic powder of claim 19, wherein the inorganic powder is electrostatically coated on the surface of the conductor.

21. A method of protecting a bare aluminum conductor from damage during heat treatment and shipment when wound on a winding form to form a coil, which comprises providing a layer of aluminum or aluminum alloy on parts of said winding form that would contact said wound conductor if not for said layer, winding said conductor onto said form to form said coil, and subsequently subjecting said coil and said form to a heat treatment followed by shipment.

22. A method according to claim 21, wherein said bare aluminum conductor has an outer surface coated with an inorganic powder.

23. A method of fabricating a bare electrical conductor that can be unwound from a coil without surface marking, sticking, catching, and breakage, which comprises forming an elongated conductor from a mass of aluminum or aluminum alloy, coating a bare outer surface of the conductor with an inorganic powder material to form a layer of the inorganic powder material held to the outer surface only by electrostatic attraction and/or a trace quantity of lubricant, winding the conductor on a winding form, and heat treating the conductor while wound on the form.

24. The method of claim 23, wherein said forming of said elongated conductor is selected from the group consisting of drawing, rolling and shaping.

25. A method of fabricating an insulated electrical conductor by coating a bare electrical conductor produced by the method of claim 23 with at least one layer of electrically insulating material.

* * * * *